US005983462A

United States Patent [19]

Roeck

[11] Patent Number: 5,983,462

[45] Date of Patent: Nov. 16, 1999

[54] EXTENSIBLE JEWELRY CLASP

[76] Inventor: James C. Roeck, 4965 NW. 108th Ter., Coral Springs, Fla. 33076

[21] Appl. No.: 09/129,169

[22] Filed: Aug. 5, 1998

[51] Int. Cl.[6] ..... A44B 11/00

[52] U.S. Cl. ..... 24/68 J; 63/5.1

[58] Field of Search ..... 24/68 J, 68 AS, 24/68 PP, 71 J, 69 J, 70 J, 300; 63/5.1, 5.2, 6; 59/79.3; 224/175; 403/229

[56] References Cited

U.S. PATENT DOCUMENTS

| | | | |
|---|---|---|---|
| 839,538 | 12/1906 | Becker . | |
| 863,836 | 8/1907 | Covell | 63/6 |
| 1,140,445 | 5/1915 | Collingwood et al. | 63/5.1 X |
| 1,621,205 | 3/1927 | Jones et al. | 59/79.3 |
| 2,457,275 | 12/1948 | Ritter | 63/5.1 X |
| 2,695,740 | 11/1954 | Kolbe | 63/5.1 X |
| 2,718,750 | 9/1955 | Spalding . | |
| 2,747,779 | 5/1956 | Speck et al. . | |
| 2,956,395 | 10/1960 | Rodriguez | 59/79.3 |
| 3,886,727 | 6/1975 | Bower | 63/5.1 X |

*Primary Examiner*—James R. Brittain
*Assistant Examiner*—Robert J. Sandy
*Attorney, Agent, or Firm*—Malin, Haley, DiMaggio & Crosby, PA

[57] ABSTRACT

A clasp mechanism that incorporates an extensible feature for ease of use is provided, which can be used on jewelry and other items. Instead of completely separating the ends of the attached jewelry or other item and then having to reconnect a clasp, the clasp mechanism separates and spreads apart by an interconnected extensible segment. The clasp can be attached to opposing ends of nearly any jewelry item, such as a bracelet, by known techniques such as soldering or bonding. The clasp incorporates an extensible segment such that when connected to opposing ends of a bracelet for example, the bracelet expands at the clasp mechanism to fit over a hand or foot and then contracts to securely fit at the wrist or ankle. The clasp mechanism does not require disconnecting and reconnecting when placing the jewelry piece onto one's person.

2 Claims, 3 Drawing Sheets

EXTENSIBLE JEWELRY CLASP

CROSS-REFERENCE TO RELATED APPLICATIONS

N/A

STATEMENT REGARDING FEDERALLY-SPONSORED RESEARCH OR DEVELOPMENT

N/A

BACKGROUND OF THE INVENTION

1. Field of the Invention

The present invention relates to an extensible linkage apparatus, and particularly to an extensible clasp for items including jewelry, such as bracelets.

2. Description of Related Art

Bracelets and like jewelry are typically worn on the wrist or ankle, and must include a mechanism to secure the jewelry piece in place. Typically, there are two ways to attach a jewelry piece such as a bracelet to the wrist or ankle. First, the jewelry piece may separate to enable it to be wrapped around the wrist or ankle, and in which case must include a clasp mechanism to attach the ends together and secure the jewelry piece so that it remains in place. Second, the jewelry piece remains intact but is extensible so that it extends or expands to enable it to slide over the hand or foot, and then contracts to remain in place on the wrist or ankle.

Clasps can be difficult to use especially for jewelry worn on the wrist as the clasp must be operated with one hand. Some users have difficulty with manual dexterity and may find any clasp difficult to operate.

Examples of extensible bracelets include U.S. Pat. Nos. 839,538 and 2,718,750. The disclosure of these patents limit the possible physical structure of the bracelets to that which can accommodate the extensible features disclosed therein. In both cases, the extensible mechanisms are disposed within the bracelets.

U.S. Pat. No. 2,747,779 includes both extensible features and a separate clasp of a bracelet watch band. The clasp includes the problems mentioned above, and the extensible features are disposed within the band, thereby incorporating the disadvantages of both mechanisms.

There exists a need for a mechanism for use on a jewelry item such as a bracelet that provides ease of use and effectively retains the bracelet upon the wrist or ankle without limiting the structure of the bracelet to one that incorporates extensible features therein.

BRIEF SUMMARY OF THE INVENTION

The present invention is a clasp mechanism that can be used for jewelry and other applications that incorporates an extensible feature for ease of use. Instead of completely separating the ends of the attached jewelry or other item and then having to reconnect the clasp, the clasp mechanism separates and spreads apart by an interconnected extensible segment.

The clasp can be attached to opposing ends of nearly any item, particularly jewelry such as a bracelet, by known techniques such as soldering or bonding. The clasp mechanism can be made of any metal, precious metal, or other material including plastics. The clasp incorporates an extensible segment such that when connected to opposing ends of a bracelet for example, the bracelet expands at the clasp mechanism to fit over a hand or foot and then contracts to securely fit at the wrist or ankle.

The extensible segment is disposed within the clasp and not within the bracelet. Therefore, the bracelet, jewelry piece, or other item can be nearly any structure because the extensible mechanism is disposed within the clasp and not within the jewelry piece itself.

Accordingly, it is an object of the present invention to provide a clasp mechanism that includes an extensible interconnected segment.

It is another object of the present invention to provide a clasp that attaches by known methods to the opposing ends of the jewelry piece or other item.

It is yet another object of the present invention to provide an extensible clasp mechanism for attachment to a plurality of different jewelry structures.

In accordance with these and other objects which will become apparent hereinafter, the instant invention will now be described with particular reference to the accompanying drawings.

DETAILED DESCRIPTION OF THE INVENTION

Figure 1:
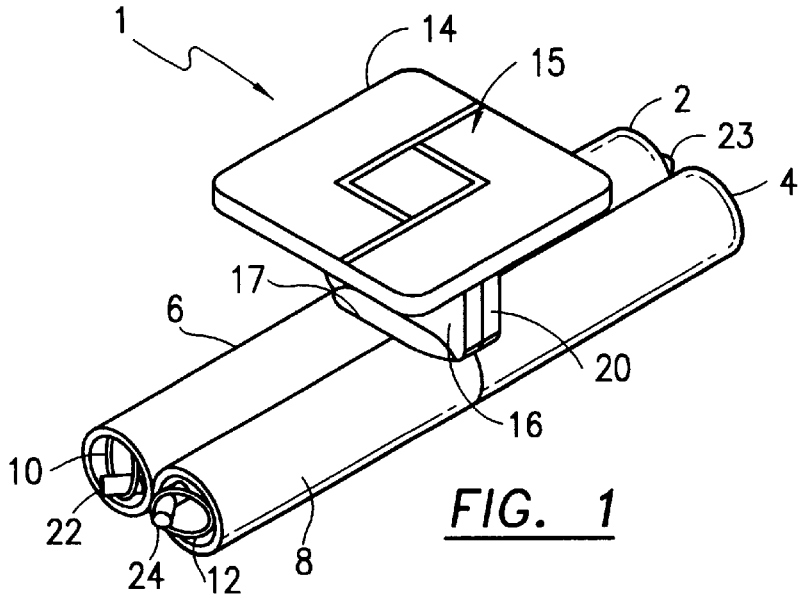
FIG. 1 is a top perspective view of one embodiment of the present invention.
Figure 2:
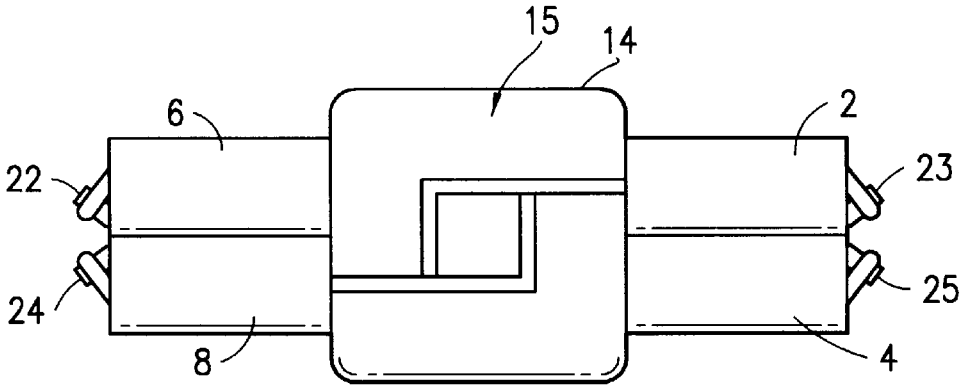
FIG. 2 is a top plan view of the embodiment of FIG. 1.
Figure 3:
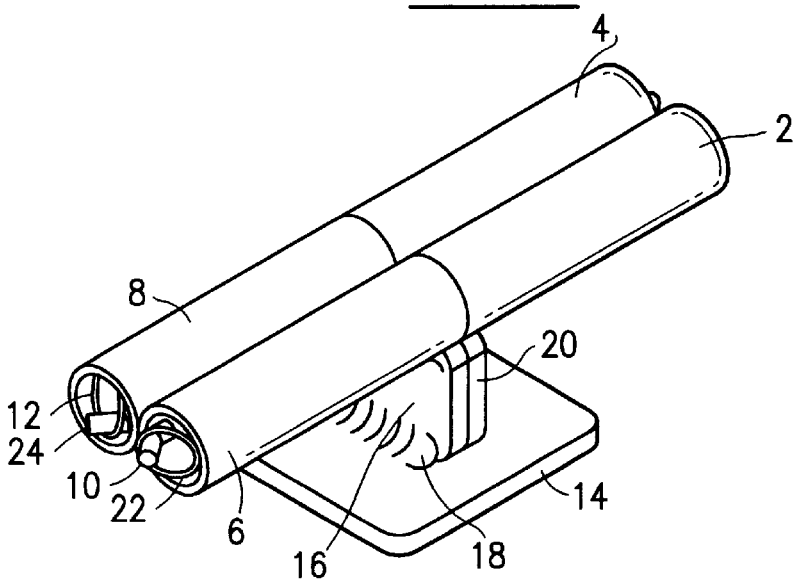
FIG. 3 is a bottom perspective view of the embodiment of FIG. 1.

Referring to FIGS. 1–3, one embodiment of the present invention, which is suitable for use in jewelry items, is illustrated generally at 1, and includes a pair of extensible links comprising spring housing members 2 and 4, spring housing members 6 and 8, and internal springs 10 and 12, respectively. The selection of the number of extensible links is preselected according to the particular application. Two side-by-side links are illustrated herein for example purposes only. Similarly, the shape of spring housing members 2, 4, 6, and 8 are illustrated as tubular, but can be preselected to be nearly any other shape.

Decorative plate 14 is illustrated with a preselected surface finish 15, as shown in FIGS. 1 and 2. Plate 14 and finish 15 can be altered according to the application. Decorative plate 14 is attached to bracelet bulkhead 16 in a suitable manner as known in the art, such as soldered 18, as shown in FIG. 3. Bracelet bulkhead 16 is also attached to spring housing members 6 and 8 in known manner, such as solder 17. Bracelet bulkhead 20 is attached to spring housing members 2 and 4 in a similar manner. Decorative plate 14 is not connected to bracelet bulkhead 20.

Spring 10 is connected to spring housing members 2 and 6 by any suitable manner, such as post members 22 and 23, respectively. Spring 12 is connected to spring housing members 4 and 8 by a suitable manner such, as post members 24 and 25, respectively. The ends of housing members 2 and 4 adjacent posts 22, 23, 24, and 25, can be cut on an angle, such as 45 degrees, to make it easier to attach springs 10 and 12 to their respective posts.

Figure 6:
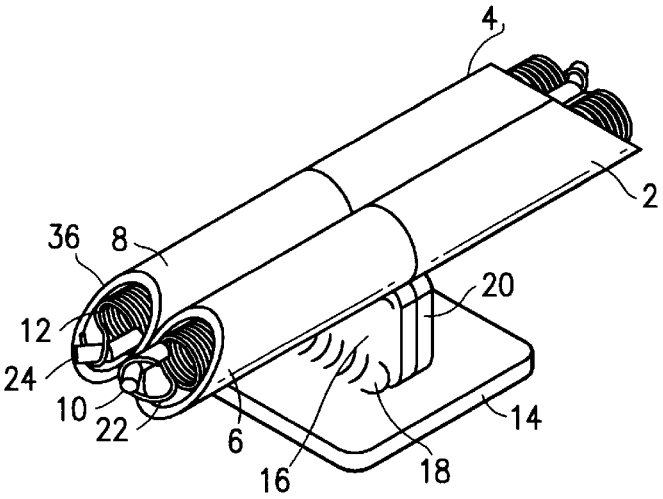
FIG. 6 is a bottom perspective view of an alternate embodiment of the present invention.

Referring to FIG. 6, the angled cuts 36 on the exterior ends of housing members 2, 4, 6, and 8, are illustrated. FIG. 6 is identical to the embodiment illustrated in FIG. 3, with the addition of the angled cuts 36 on each housing member, 2, 4, 6, and 8.

Posts 22–25 can be connected in a suitable manner, such as soldered or bonded, to each of their respective spring housing members. Springs 10 and 12 can be any biasing mechanism including conventional springs, elastic bungies, and the like, which may be connected to bulkheads 16 and 20 in any suitable manner.

Figure 4:
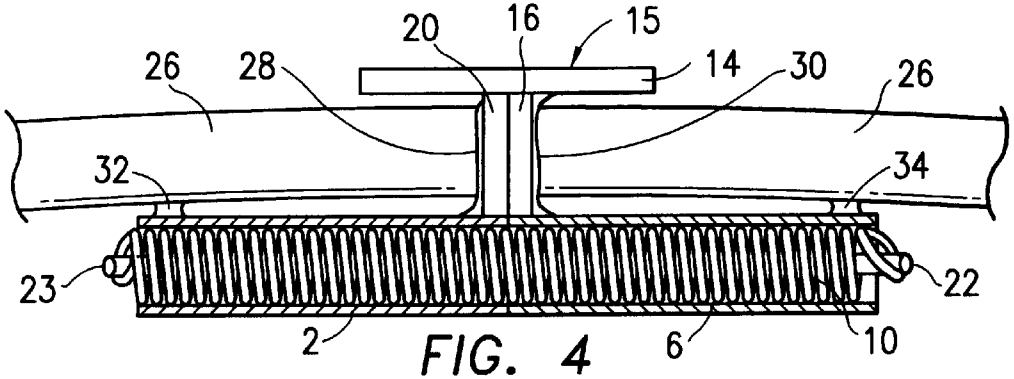
FIG. 4 is a side elevational view, partially cut-away, of the embodiment of FIG. 1, shown attached to a jewelry piece.
Figure 5:
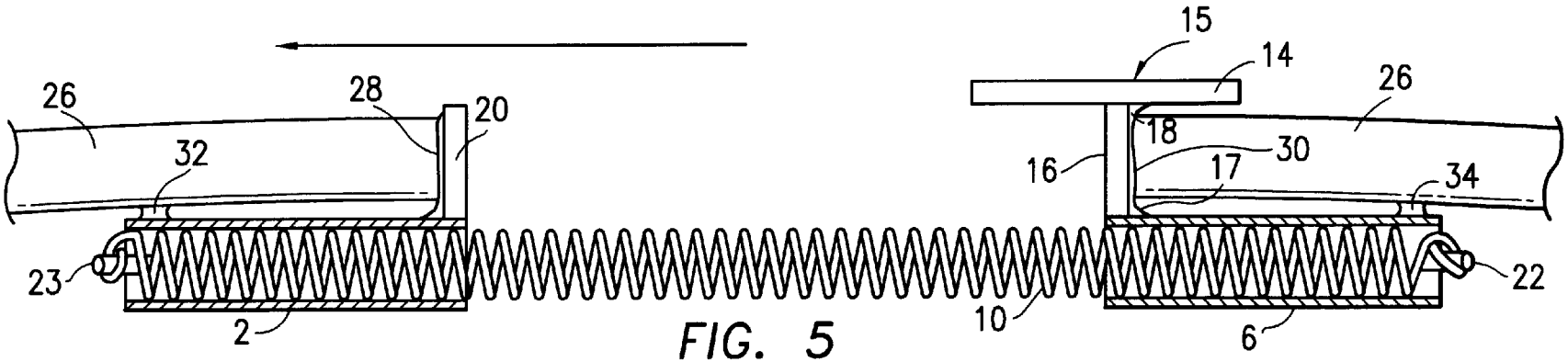
FIG. 5 is a side elevational view, partially cut-away, of the embodiment of FIG. 1, shown attached to a jewelry piece and in the extended position.

Referring to FIGS. 4 and 5, opposing ends of bracelet 26 are connected to bulkhead 20 and to bulkhead 16, in any suitable manner such as solder at 28 and 30, respectively. Bracelet 26 can further be soldered at 32 and 34 to the respective spring housing members, of which 2 and 6 are illustrated in FIGS. 4 and 5. Bracelet 26 can be any size or shape jewelry piece, as the extensible clasp mechanism is not within the bracelet.

Referring to FIG. 4, the contracted position of springs 10 (shown) and 12 is illustrated in which bulkheads 16 and 20 are disposed adjacent each other. The opposing ends of bracelet 26 are thus adjacent each other and essentially closing the bracelet where it can be retained around a wrist or ankle.

FIG. 5 illustrates the extended position of springs 10 (shown) and 12 in which the opposing ends of bracelet 26 are separated to permit sliding bracelet 26 over a body part such as a hand or foot. As illustrated in FIGS. 4 and 5, bracelet 26 remains attached to the clasp mechanism 1, and expands to allow placement over a hand or wrist. No clumsy clasp need be reattached when adorning the jewelry piece.

In an alternate embodiment, the housing members 2, 6 and 4, 8 can have one or more extended portions having a smaller outer diameter than the inner diameter of the mating housing member such that one housing member partially fits into its mating housing member to provide better alignment and additional rigidity when closed.

Figure 7:
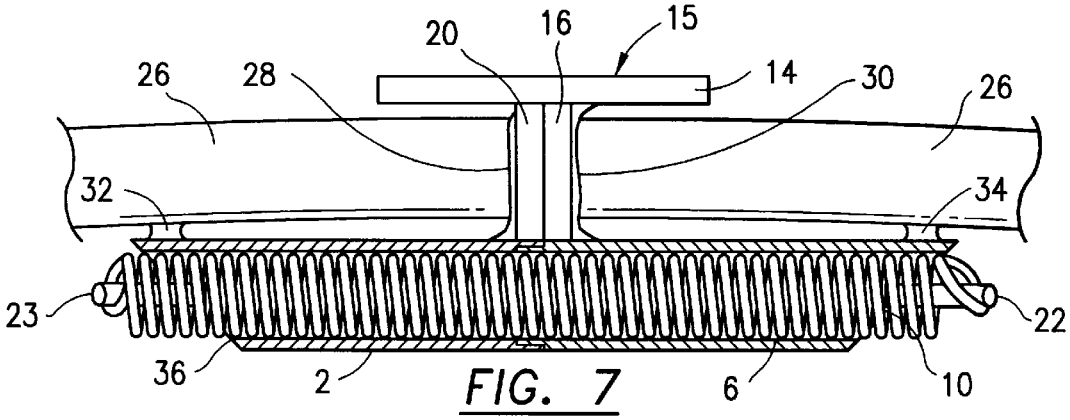
FIG. 7 is a side elevational view, partially cut-away, of the embodiment of FIG. 6, shown attached to a jewelry piece.
Figure 8:
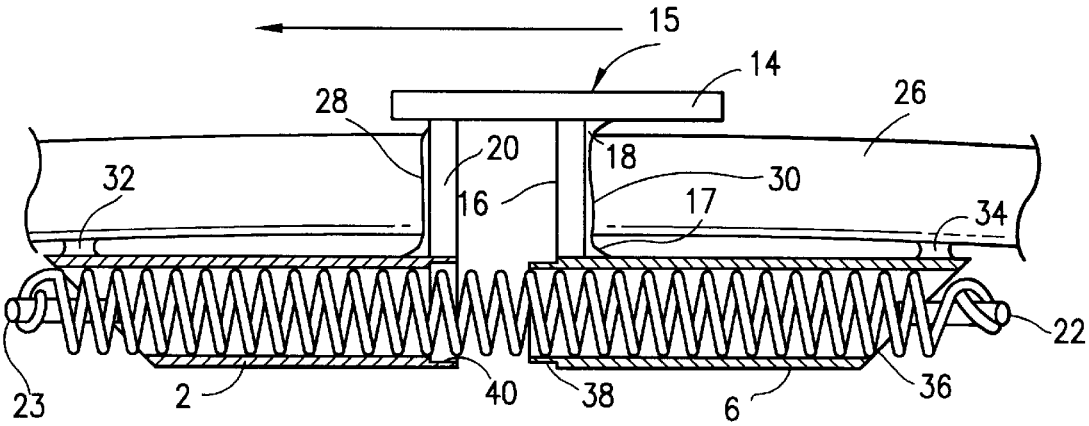
FIG. 8 is a side elevational view, partially cut-away, of the embodiment of FIG. 6, shown attached to a jewelry piece and in the extended position.

For example, referring to FIGS. 7 and 8, an extended portion 38 of housing members 6 and 8 is sized to fit into increased inner diameter section 40 in adjacent housing members 2 and 4. The resulting "tube within a tube", as shown in FIG. 7, provides additional rigidity and alignment when desired for certain applications.

The embodiment illustrated in FIGS. 7 and 8 includes angled ends 36 on housing members 2, 4, 6, and 8, but could have non-angled ends similar to the embodiment illustrated in FIGS. 1–5.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An extensible jewelry clasp, comprising:

a first housing member, said first housing member being substantially elongated and having a first end and a second end disposed along a first housing longitudinal axis;

a second housing member, said second housing member being substantially elongated and having a first end and a second end disposed along a second housing longitudinal axis;

said first housing member and said second housing member being moveable between a first position having said first housing longitudinal axis and said second housing longitudinal axis being substantially collinear and with said first housing first end and said second housing first end disposed adjacent each other, and a second position with said first housing longitudinal axis and said second housing longitudinal axis being substantially collinear and with said first housing first end and said second housing first end disposed separated apart from each other;

means for biasing said first housing member and said second housing member in said first position, said means for biasing being extensible so that said first housing member and said second housing member are moveable to said second position; and, means for attachment of said first housing member and said second housing member to opposing ends of a jewelry piece;

wherein, said means for biasing is a spring, said spring including means for attachment to said first housing second end and to said second housing second end, said spring being disposed substantially within said first and said second housing members;

a first plate member connected to said first housing member adjacent said first housing member first end and substantially perpendicular to said first housing longitudinal axis; and a second plate member connected to said second housing member adjacent said second housing member first end and substantially perpendicular to said second housing longitudinal axis, wherein opposing ends of the jewelry piece are attachable to said first plate and said second plate.

2. An extensible jewelry clasp, comprising:

a first housing member, said first housing member being substantially elongated and having a first end and a second end disposed along a first housing longitudinal axis;

a second housing member, said second housing member being substantially elongated and having a first end and a second end disposed along a second housing longitudinal axis;

said first housing member and said second housing member being moveable between a first position having said first housing longitudinal axis and said second housing longitudinal axis being substantially collinear and with said first housing end and said second housing first end disposed adjacent each other, and a second position with said first housing longitudinal axis and said second housing longitudinal axis being substantially collinear and with said first housing first end and said second housing first end disposed separated apart from each other;

means for biasing said first housing member and said second housing member in said first position, said means for biasing being extensible so that said first housing member and said second housing member are moveable to said second position; and, means for attachment of said first housing member and said second housing member to opposing ends of a jewelry piece;

a first plate member connected to said first housing member adjacent said first housing member first end, said first housing member having a longitudinal axis and said first plate member being substantially perpendicular to said first housing longitudinal axis; and a second plate member connected to said second housing member adjacent said second housing member first end said second plate member having a longitudinal axis and said second plate member being substantially perpendicular to said second housing longitudinal axis, wherein opposing ends of the jewelry piece are attachable to said first plate member and said second plate member.

* * * * *